US005887951A

United States Patent [19]

Willingham

[11] Patent Number: 5,887,951

[45] Date of Patent: Mar. 30, 1999

[54] ORTHOPEDIC SEATING ORTHOSIS FOR CORRECTING POSTURE AND RESTRICTING GLUTEAL SPREADING

[76] Inventor: W. Preston Willingham, 245 Woodside Ave. P.O. Box 3921, Park City, Utah 84060-3921

[21] Appl. No.: 741,343

[22] Filed: Oct. 29, 1996

Related U.S. Application Data

[63] Continuation-in-part of Ser. No. 528,987, Sep. 15, 1995, abandoned.

[51] Int. Cl.[6] ..... A47C 7/02

[52] U.S. Cl. ..... 297/452.23; 297/258.1

[58] Field of Search ..... 297/452.15, 452.21, 297/452.23, 452.24, 452.25, 452.22, 452.28, DIG. 2, 271.5, 452.4, 452.55, 284.2, 284.1, 284.9, 284.11, 258.1; 482/142, 146, 147; 472/135

[56] References Cited

U.S. PATENT DOCUMENTS

| | | | |
|---|---|---|---|
| D. 142,800 | 11/1945 | Watson | 297/452.23 X |
| 3,006,688 | 10/1961 | Ouellette | 297/452.15 |
| 3,138,404 | 6/1964 | Newton | 297/452.24 X |
| 3,177,036 | 4/1965 | Halter | 297/452.25 |
| 3,389,936 | 6/1968 | Drabert | 297/452.24 |
| 3,422,938 | 1/1969 | Worcester | 297/452.24 X |
| 3,463,547 | 8/1969 | Brennan et al. . | |
| 3,526,429 | 9/1970 | Metzger . | |
| 3,583,759 | 6/1971 | Kramer | 297/452.23 X |
| 3,712,670 | 1/1973 | Svehla et al. | 297/452.24 X |
| 3,740,096 | 6/1973 | Bridger . | |
| 4,962,964 | 10/1990 | Snodgrass | 297/452.15 |
| 5,022,709 | 6/1991 | Marchino | 297/452.24 |
| 5,048,823 | 9/1991 | Bean . | |
| 5,154,485 | 10/1992 | Fleishman | 297/452.15 X |

*Primary Examiner*—Milton Nelson, Jr.
*Attorney, Agent, or Firm*—Thorpe, North, & Western, L. L. P.

[57] ABSTRACT

An orthopedic device intended to be contacted by the lower pelvic region of a seated user, the device principally involving a foundation member comprising a central bowl portion serving to receive the lower pelvic region of the seated user. The central bowl portion is integrally connected to a front lip-like portion intended to be contacted by the under thighs of the seated user. The central bowl portion is also bounded by an upwardly inclined rear portion and a pair of upwardly curving side portions closely related with the central bowl portion. The side portions curve upwardly somewhat higher than the central bowl portion and serve to interconnect the rear portion with the front, lip-like portion. The weight of the seated user causes the side portions to move inward and upward so as to cup around the lower pelvic region of the seated user. Each of the side portions may have an enlarged, bead-like member extending along its uppermost edge, with the bead-like members and the side portions forming tension members extending between the front, lip-like portion and the rear portion of the foundation member.

4 Claims, 7 Drawing Sheets

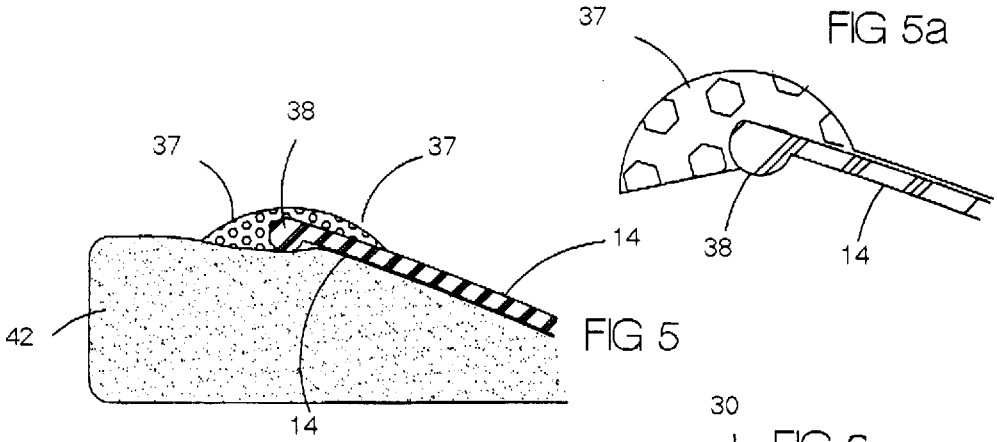
FIG 5
FIG 5a
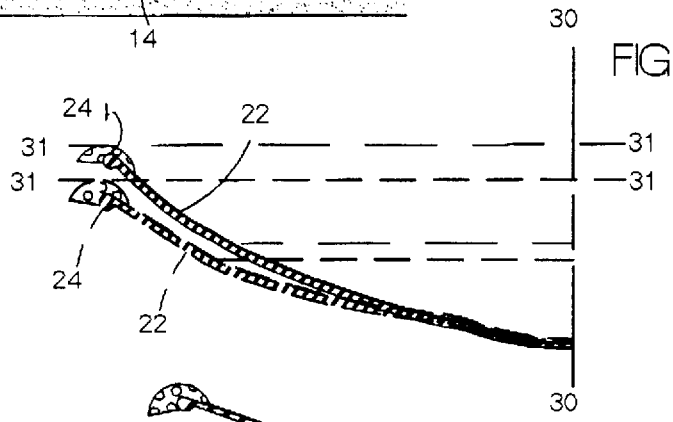
FIG 6
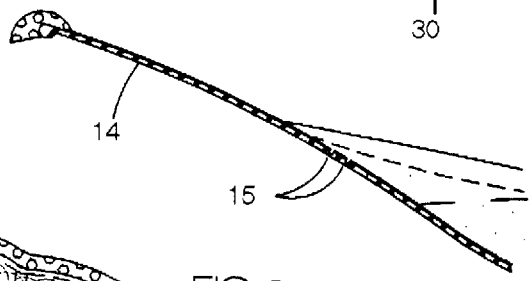
FIG7
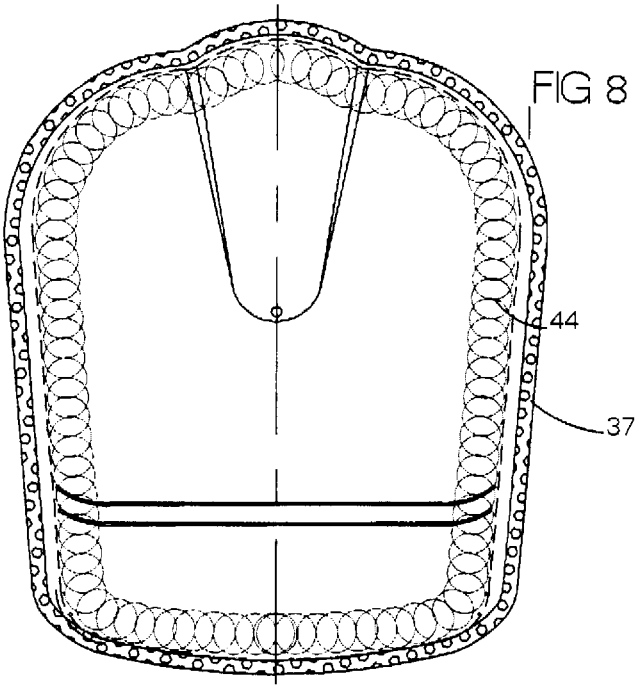
FIG 8

ORTHOPEDIC SEATING ORTHOSIS FOR CORRECTING POSTURE AND RESTRICTING GLUTEAL SPREADING

RELATIONSHIP TO EARLIER INVENTION

This is a Continuation-in-Part of my application "LUMBRO-SACRAL SEATING ORTHOSIS FOR CORRECTING POSTURE AND RESTRICTING GLUTEAL SPREADING," Ser. No. 08/528,987, filed Sep. 15, 1995, now abandoned.

BACKGROUND OF THE INVENTION

From the beginning of recorded history, most seating surfaces have been hard, but these were eventually followed by seats constructed of resilient material. In recent years, flexibility seating called ergonomic has been evolved. This evolution now continues with a lumbro-sacral seating orthosis in accordance with the instant invention, which will be described in detail hereinafter.

The art of designing body supports, in the nature of chairs and sofas having posterior and lumbar supporting portions, has thus far taken into consideration man's need to have a comfortable and flexible support that continuously conforms to different body positions. For example, chairs and sofas are known to be constructed from posterior and lumbar supporting assemblies consisting generally of a frame having a plurality of springs, a cushion or pad which rests on the springs, and an upholstery cover. These assemblies, although flexible due to their spring construction, assume a predetermined fixed shape which requires that for maximum comfort, persons using such furniture must adjust their body positions relative to these assemblies.

Inasmuch as chairs and sofas are a vital part of man's work and leisure environment, there is a distinct need for providing a body support which is constructed to continuously conform to man's different body positions in order to provide maximum comfort. Thus from hard seating and resilient seating, the next generation, called ergonomic seating, evolved.

There are many ergonomic supports in the nature of chairs, sofas and the like which include flexible and resilient supporting portions which conform to the body to provide comfort. All of these posterior and lumbar supporting sitting surfaces, whether contoured or non-planar, have the ability to form a plurality of cantilevers which automatically adjust and conform to human body movement without mechanical parts, as opposed to adjusting the human body to conform to the supporting portion of the seating surface.

Various ergonomic seats have been proposed for posterior and lumbar supporting assemblies which are designed to possess increased flexibility while providing body support. Such structures are known for example, from U.S. Pat. No. 4,502,731 to Snider, U.S. Pat. No. 4,418,958 to Watkin, U.S. Pat. No. 5,123,702 to Caruso, U.S. Pat. No. 5,076,646 to Matte, U.S. Pat. No. 4,660,887 to Fleming et al, and U.S. Pat. No. 3,389,936 to Drabert. However, each of these structures merely provide an assembly having a plurality of openings to increase flexibility. They also are designed in a manner which permits their continuous adjustment in conforming to different body positions to maximize comfort.

The art of designing a body support to provide maximum comfort has reached a very high level of achievement, but in providing this comfort, a hidden problem has arisen. Although these flexible, conforming, comfortable, ergonomic seating devices are an improvement over hard wooden or resilient seating surfaces, the injury to the back has increased dramatically after the advent of such ergonomic seating. The forces of gravity once felt by the sitting bones (ischial tuberosities) have been transferred up into the pelvis and spine and onto the thigh muscles and gluteal muscles.

None of these various approaches to maximizing comfort through increased flexibility and conforming to different body position apparently foresaw that the reduced pressure on the ischial tuberosities would transfer the pressure to the spine and pelvis. Nor can these flexible ergonomic seats promote what is being called the "loose pack position" of the spine or restrict gluteal spreading. The "loose pack position" of the spine in a seated position is being widely accepted by orthopedists and physical therapists as the correct lordotic curve for a seated person. This is diametrically in contrast with the teachings that ergonomic seat designers have been using prior to this time. These teachings can be found in U.S. Pat. No. 4,660,887 to Fleming et al, and in U.S. Pat. No. 4,418,958 to Watkin. A significant quotation from the Watkin patent is as follows:

"It is desirable that a chair should be shaped to provide support for the spine and thighs of someone sitting on the chair so that the spine is supported in the orthopedically preferred position. This position is described in British patent specification No. 1,294,091 and in the brochure 'S Range' published in the United Kingdom by Arenson International Limited of St. Albans. Ideally, the sitter's spine should be supported in an approximately vertical elongate 'S' shape whose curves define a plane transverse to the back support of the chair, the lower curve being concave to the back support and being defined by the lumbar and lower thoracic vertebrae while the upper curve is convex and is defined by the upper thoracic and cervical vertebrae . . . . It is also desirable that pressure on the ischial tuberosities of the sitter be reduced. Support of the spine in the 'S' shape achieves this to some extent by transferring some of the load on the ischial tuberosities to the underside of the thighs."

With regard to the teaching of transferring pressures from the ischial tuberosities to the thighs and gluteus muscles, as a preferred ergonomic benefit, it is now understood that gluteal spreading, commonly known as "secretary spread" is as injurious to the pelvis and spine as incorrect posture. The anthropometric measurement system for ergonomic seating does not teach gluteal cupping as does the instant invention. No matter how comfortable an ergonomic seating device is, continuous sitting on anthropometrically measured "S range" seating devices will in most humans result in repetitive stress injuries to the back.

Likewise, none of these support assemblies restrict gluteal spreading, medically known as gluteal flexion, sufficiently to shut off the trigger response of the sacro-coccygeal ligaments or prevent the uneven pressure on the pelvic ligaments. Continual spreading (flexion) of the gluteal muscles and flexion of the pelvis bones have been found to result in repetitive stress injuries to the pelvic ligaments, hip joints and sacro-coccygeal ligaments.

There are other known portable collapsible or stationary ergonomic support structures that purport to provide sufficient ergonomic support. These structures shift and assume different body positions in an effort to provide an effectively comfortable ergonomic support to the entire soft tissue of the human body. Such structures are known, for example, in U.S. Pat. No. 3,138,404 to Newton, U.S. Pat. No. 2,551,819 to Wing, U.S. Pat. No. 3,422,938 to Worcester, U.S. Pat. No. 4,533,174 to Fleishman, U.S. Pat. No. 4,202,581 to Fleischman, U.S. Pat. No. 2,663,359 to Wood, U.S. Pat. No. 2,380,102 to Farmer, U.S. Pat. No. 3,422,938; U.S. Pat. No. 4,435,015 to Trotman et al, U.S. Pat. No. 3,389,936 to Drabert and U.S. Pat. No. 3,712,670 to Svehla et al.

No matter how comfortable a portable or stationary ergonomic seating device appears to be, without an individual's spine maintaining a "loose pack position," these portable ergonomic "S range" contour seating devices will in most humans result in repetitive stress injuries to the back.

It can therefore be appreciated that there has been an unsolved need for a portable lumbral sacral sitting orthosis that is distinctly different from known portable or stationary ergonomic chairs and the like. As well be seen in detail hereinafter, my novel design involves a sitting device that corrects posture to a "loose pack position," restricting the flexion of gluteal spreading. It is sincerely believed that no other sitting surface has addressed this novel feature, whether ergonomic, flexible, fixed shaped, portable or stationary.

SUMMARY OF THE INVENTION

As will be seen in detail hereinafter, my novel seating orthosis makes effective use of memory intensive flexible plastics for the creation of energy that propels mechanical function. This of course is in contrast with ergonomic flexibility, which is concerned with conforming to static forces and softening the effects of hard surfaces on skeletal pressure points.

Whereas the state of the art teachings have not provided for an individual to sit in the "loose pack position," I have evolved a device providing a unique lordotic curve for each individual.

To find an individual's "loose pack position," one must sit on a device that will allow the pelvis to articulate in a forward tilt, but not be forced into any predetermined "S" shape curve. The term "loose pack position" comes from the fact that when an individual's spine is in its most preferred position, the vertebrae are stacked over one another with the least pressure and the least need for muscles to correct the sitting position. This can only be achieved with a device that promotes the forward tilt of the pelvis. Thus, my novel device allows the spine, which is a closed kinematic chain, to follow the direction of the pelvis until the spine is stopped by its own ligament and muscles groups naturally. For more than 60 years, specialists in human engineering have accepted one set of anthropometric measurements for proper posture.

Through my own efforts I have found that there is not just one anthropometric measurement that provides this orthopedic benefit. Each spine's preferred curve is different, thus the need for a seating device that will promote the "loose pack position." My novel seating orthosis teaches a forward tilt that permits the pelvic region of each individual to find his or her unique loose pack position rather than having to conform to the previously accepted "S-shaped" postural position.

As to the construction of my novel orthopedic device allowing for loose pack positioning and restricting gluteal spreading, it principally comprises a foundation member having a circular central bowl portion. A lip-like front portion extends forward from the central bowl portion, and an upwardly inclined rear portion extends rearward from the central bowl portion. Significantly, I utilize upwardly inclined side portions that extend around the perimeter of the central bowl portion in a manner connecting the front and rear portions of the foundation member. I prefer to provide enlarged, bead-like members extending along the uppermost portions of these side portions, each of which members forms a type of tension member extending between the front and rear portions, provided for an important purpose later described herein.

The foundation member utilizes a specific memory retentive flexible material, and I prefer the use of 130,000 PSI block co-polymer polypropylene. The front, lip-like portion of my novel orthopedic device, positioned to be contacted by the underside portion of the user's thighs, is flexible, and in accordance with one embodiment of my invention, a pair of generally parallel grooves is disposed across the front of the central bowl portion with both of such grooves being substantially perpendicular to the longitudinal centerline. The grooves serve to increase the flexibility of the front portion as well as to simplify the front portion readily bending downwardly in a predictable manner at the time the hamstring portions of the legs and the buttocks of a user are placed on the front and central portion of the device. Quite advantageously, when the front and central bowl portions of the foundation member bear the weight of a properly positioned pelvis, and the forward portion is contacted by the undersurface of the user's thighs, the front and central bowl portions of the foundation member deform into a controlled secondary shape. In its fully deformed specific secondary shape, the front, lip-like portion of the foundation member is bent downward, placing the side members and bead-like periphery members under tension. This specific secondary shape causes the central bowl portion to undertake a circular bowl shape.

In accordance with my novel design, the balance point under the center of the central bowl portion shifts from the center of the bowl portion forward, tilting the entire foundation member forward toward the front, lip-like member. The side edges of my foundation member extend from the front portion, around and above the central bowl portion, and terminate at the rear portion. These side edges consist of the upward sloping segments adjacent to the central bowl portion which include the periphery of the central bowl portion foundation member. These upwardly sloping side portions have a specifically greater upward curve than the upward curve of the central bowl portion. They taper in width from their widest value near the central bowl portion to zero width at the front corners and connect to the rear portion without reduction in width.

It is to be understood that when the front lip-like portion is bent downward, the upwardly curved side portions are placed under tension. The combination of the specific secondary shape and side members, when brought under tension, increase the side members' upward curve. Simultaneously and most significantly, the side portions are pulled inward at this time, toward the centerline of the central bowl portion. This results in a novel, highly advantageous inward cupping action that is asserted against the outwardly pushing forces of body weight. This cupping effect is concentrated around the bottom of the pelvis without having to support the musculature and soft tissues of the entire buttocks. Thus, the muscle tissue is held constant under and around the ischial tuberosities, promoting good posture and great comfort to the seated user.

The combination of the specific secondary shape and the side members brought under tension do not allow the integrity of the specific secondary shape to deform outwardly beyond the specific secondary shape. This inwardly cupping movement maintains its ability to cup inwardly as long as the weight of the user does not exceed 400 pounds.

It is to be understood that the novel foundation portion of my seating orthosis is bisected by a longitudinal centerline extending the distance between the front and rear portions. My foundation is also bisected by a lateral centerline extending through the center of the central bowl portion.

My seating orthosis is designed to fit the medically and scientifically accepted average pelvic bones measurements which have been calculated to include the world's sex, race, height and age. The pelvis, unlike the leg and arm bones, has a small range of widths, depths and heights, allowing me to create a device that effect a human in a seating position by only supporting a small portion of the pelvis rather than the entire buttocks. The buttocks are of course made up of soft tissues, the configuration of which varies greatly with every human.

All of the novel structure provided in accordance with this invention is in direct conformity with, and proportional to, pelvic dimensions. The relationship between the lower pelvic dimensions and the dimensions and shape of my device is most significant. No other seating device is known to have utilized and taken into consideration, these lower pelvic dimensions.

The diameters of the outlet of the pelvis are two, antero-posterior and transverse. The antero-posterior extends from the tip of the coccyx to the lower part of the symphysis pubis; its average measurement is three and a quarter inches in the male and five in the female.

Another aspect of my device concerned with creating comfort is the overhanging foam member extending from the periphery of the entire device. This overhanging foam member is provided to lessen the effects that the side members along with its bead-like member have when pushing up into the musculature of the buttocks. Since my novel device is not intended to cradle the entire buttocks, this peripheral overhanging foam acts as a type of gasket between the device and any parent surface upon which my device is placed.

It is quite unobvious, even to those carefully schooled in the art of seat design, to utilize upwardly sloping walls that cup snugly around the outlet of the lower pelvis, and in doing so, to push up into the buttocks of the seated user. I provide an overhanging peripheral member of soft texture that enables this upwardly sloping wall to push into the buttocks muscles without creating an uncomfortable transition point.

An important mechanical aspect of ny novel seating orthosis involves the central bowl portion tilting forward during usage from its central balance point to a forward balance point, with this serving to shift the pelvis into a position that cannot be achieved by ordinary ergonomic seats. It is the dimensional relationship to the shape and size of the human pelvis that allows the mechanical functions to occur in accordance with this invention. It is the specific secondary shape that articulates the pelvis in specific forward directions to achieve the previously described "loose pack" postural sitting position. The energy to accomplish these functions comes from the weight of the body forcing the structures into the novel secondary shape. The resulting static force against memory plastics under tension propels the tilting and inward cupping that act as predetermined mechanical functions.

It is thus to be seen that the measurements of the pelvis bones dictate my design's measurements. This is in contrast with all other known seating devices which, regardless of construction, are based on the anthropometric measurements that include the overall width of soft tissues that make the hip widths, and that only consider the transverse measurements of the pelvis to locate the central point of their design.

If my novel device is attached to any surface, not allowing it to be able to spin, slide, tilt or rotate, this would render its function substantially useless. Rather, my novel device is designed to be placed on any surface one chooses to use as a "parent" surface. It must be positioned with respect to the lower pelvis of the seated user for it to function properly. Where and how the seated user wishes to sit does not effect the instant novel device's function. Whether the device is placed on a hard surface, a resilient surface, a soft surface, or a ergonomic surface, it will bring about the prevention or the relief of repetitive stress disorders caused by continual sitting.

It can therefore to be seen that my novel orthosis is a sitting device that corrects posture to a "loose pack position," restricting the flexion of gluteal spreading, which no other sitting surface has addressed, whether these be ergonomic, flexible, fixed shaped, portable or stationary.

The tilting action brought about by my orthopedic device has two distinct benefits. First, a forward tilt of the pelvis creates a correct lordotic curve. This correct posture places the spine and pelvis into their neutral position, which allow the joints, ligaments, and muscles to remain in a relaxed form, often referred to as a "loose pack" position. Second, this corrected posture transfers upper body weight off the spine, through the pelvis into the ischial tuberosities. It is well known that the ischial tuberosities are the ideal weight bearing bone structure when the user is in a seated position.

With regard to the novel cupping action produced by the use of my novel seating orthosis, this has four distinct benefits. First, the ischial tuberosities are suspended in a dome of cupped muscle tissue that is a result of the functioning of the novel side members of my device. This is important because the tilting action places upper body weight into the ischial tuberosities. This retained muscle tissue cupped and held constant at a location around and below the ischial tuberosities produce a natural cushioning effect.

Second, the omni lateral cupping compression caused by the cupping effect restricts the flattening and spreading of gluteal and piriformis muscles. This results in the primary muscle groups of the buttocks being held in a slack position. This shuts off the reflex response that tightens the three major back muscle groups that share ligaments with the gluteus muscles.

The third benefit of the novel cupping action achieved by my novel orthosis involves the sacrum and its sacrococcygeal ligament group being cradled in a non-pressure position, which allows for the gentle pumping motion of the cranial sacro mechanism, by way of the dura attachment of the sacrum. Sacral pumping action pumps cerebral fluid through the spinal column.

Fourth, upper body weight carried by the ischial tuberosities and retained muscle tissue is then transferred into the device itself. Acting as an exoskeleton, upward pressure of the seating surface is unable to push up through the device, so internal soft tissue and organs of the buttocks region are protected from outside pressures and remain in a relaxed form.

It is a primary object of my invention to provide a seating orthosis involving a foundation member configured to bring about novel tilting and cupping actions when sat on by a user, which serve to greatly reduce if not eliminate back pain, and to improve posture.

It is a more specific object of my invention to provide a seating orthosis having front, central and rear portions bounded by side members, with the upper portions of the side members forming tension members that pull inward toward the centerline of the orthosis when the front portion is held down by the legs of the user, with these tension members also pulling the rear portion forward and the side members pulling the gluteal muscles inward to as to create a novel cupping effect around the ischial tuberosities while still permitting the outer gluteal muscles to remain in a slack position, this to improve posture and relieve back pain.

It is another object of my invention to provide a seating orthosis having forward, central and rear portions bounded by side members, with the upper portions of the side members having novel tension members serving to pull the rear portion of the device toward the front portion, with the rear portion pushing on the top of the posterior pelvic girdle, promoting forward tilt of the entire pelvis and transferring most of the upper body weight onto the lower pelvis, with this serving to improve posture and relieve back pain.

It is still another object of my invention to provide a seating orthosis having forward, central and rear portions bounded by side members, with the side members serving to counteract the natural tendency of the gluteal muscles to spread when a user undertakes a sitting position, the members serving to cradle muscle tissue directly below the lower pelvis, advantageously holding a constant layer of muscle tissue between and around the ischial tuberosities and the device and providing an exceedingly comfortable device upon which the user can sit for long periods of time without discomfort or fatigue.

It is yet another object of my invention to provide an orthopedic device having front, central and rear portions bounded by side members, with this device having novel structural relationships that interact simultaneously when a user properly position his or her ischial tuberosities (Lower pelvis) into the cup-like central portion of the device at the time the user assumes a proper seated position on the device.

It is yet still another object of my invention to provide an orthopedic device having front, central and rear portions bounded by side members, with the central portion being cup shaped or bowl shaped and becoming significantly deeper at such time as the front portion bends downward under the weight of the user's legs, and with the side portions bending inward toward the longitudinal centerline of the device and the rear portion pushing toward the front portion, with this omni-lateral compression of the gluteal muscles increasing the highly advantageous cupping effect around the ischial tuberosities achieved by my novel device.

It is yet still another object of my invention to provide a novel seating orthosis having front, central and back portions with the front, lip-like portion, when bearing the weight of the user's upper leg portions, causing the central portion of the device to tilt forward on its bowl shaped undersurface toward the front portion, with this promoting forward tilt of the user's entire pelvis and in turn serving to improve posture and relieve back pain.

It is yet still another object of my invention to provide a novel seating orthosis having forward, central and back portions, with the front, lip-like portion, when bearing the weight of the user's upper leg portions, causing the central portion of the device to tilt forward on its bowl shaped undersurface toward the front portion until the front portion comes into direct contact with the parent surface upon which my seating orthosis rests.

These and other objects, features and advantages of my invention will become more apparent as the description proceeds.

BRIEF DESCRIPTION OF DRAWINGS

FIG. 5 is a cross sectional view of a portion of my device to approximately full scale, with this figure illustrating how the overhanging transitional soft textured padding extends beyond the forward edge of the foundation member so as to make a smooth transition to the seat member or parent surface upon which my novel device has been placed;

FIG. 5*a* is a view to a larger scale than FIG. 5 in order to reveal some additional detail of the transitional member attached to the periphery of the forward bead, with the transitional member being in the configuration it assumes when the foundation member is not in a weight bearing mode;

FIG. 6 shows a superimposed partial cross sectional view bearing some resemblance to FIG. 3*c*, this view being taken from the center of the central bowl portion and showing that under a user's weight, the side portions have a greater upward curve when the ischial tuberosities and lower pelvis have been properly placed in the central bowl portion;

FIG. 7 reveals that the bending point of the forward lip-like portion of the foundation member is in this instance defined by a pair of notches located at the top of the central bowl portion; and FIG. 8 is a top overall view of my novel seating orthosis, with a series of small interlocking circles being utilized around the periphery of the device in order to connote the locations where bonding or glue is applied in order to secure the overhanging soft padding or foam pad around the periphery of the foundation member.

DETAILED DESCRIPTION

Figure 1:
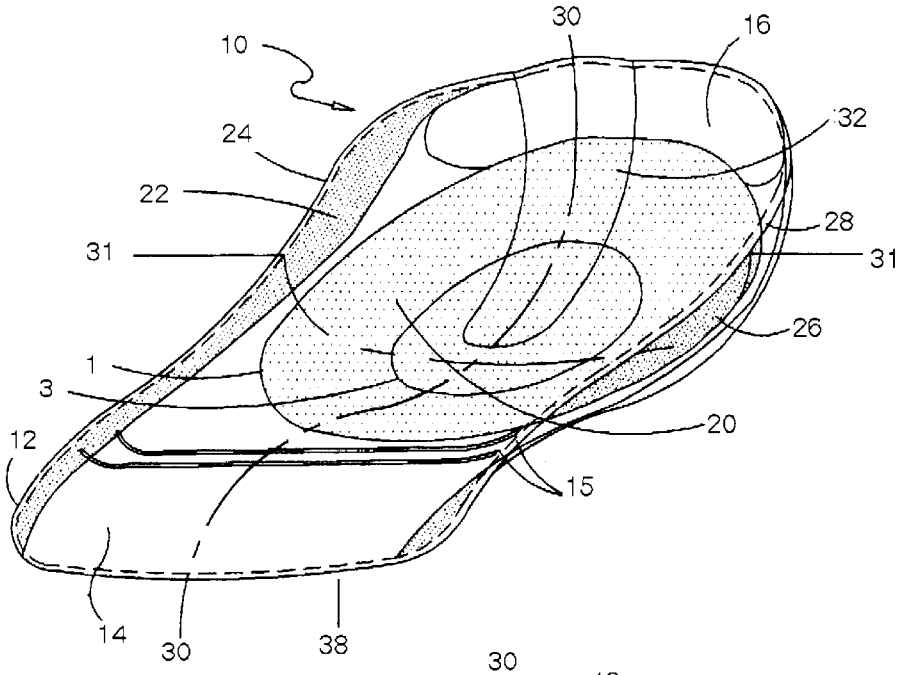
FIG. 1 is a perspective view of my novel seating orthosis, with this view revealing the forward lip-like portion, central bowl portion and upwardly inclined rear portion, with novel, upwardly curved side portions extending between the forward and rear portions.

With initial reference to FIG. 1, it will there be seen that I have shown a perspective view of an orthopedic device or seating orthosis 10 in accordance with my invention, which device is intended to be utilized by a seated user. As will be explained in detail hereinafter, my novel device 10 comprises a foundation member 12 designed to assume a highly advantageous secondary shape during use.

As will shortly be explained, my device provides a forward tilting of the entire pelvis of a seated user as well as a highly advantageous cupping effect around the lower pelvis and ischial tuberosities of the seated user. The ischial tuberosities are indicated at i in FIGS. 3*d* and 4*d*. The forward tilt of my device and the cupping of the lower pelvic region of the seated user has a distinct orthopedic benefit, which is greater than any benefit brought about by seating that has been specifically designed to provide considerable comfort for a seated user.

The foundation member 12 is preferably molded from 130,000 psi block copolymer polypropylene, that is able to maintain its memory and flexibility over a wide range of temperatures, but I am not to be limited to any particular plastic. However, in any event, the plastic used for the foundation member must have flexibility as well as excellent memory characteristics.

Although the novel foundation member in accordance with this invention is able to assume an advantageous secondary shape or configuration when bearing 90 or more pounds, there is a strong tendency for the foundation member made of this particular plastic to return to its original configuration when weight is removed, which feature is most important to my invention. More of the specific characteristics of my novel foundation member will be discussed hereinafter.

Figure 2:
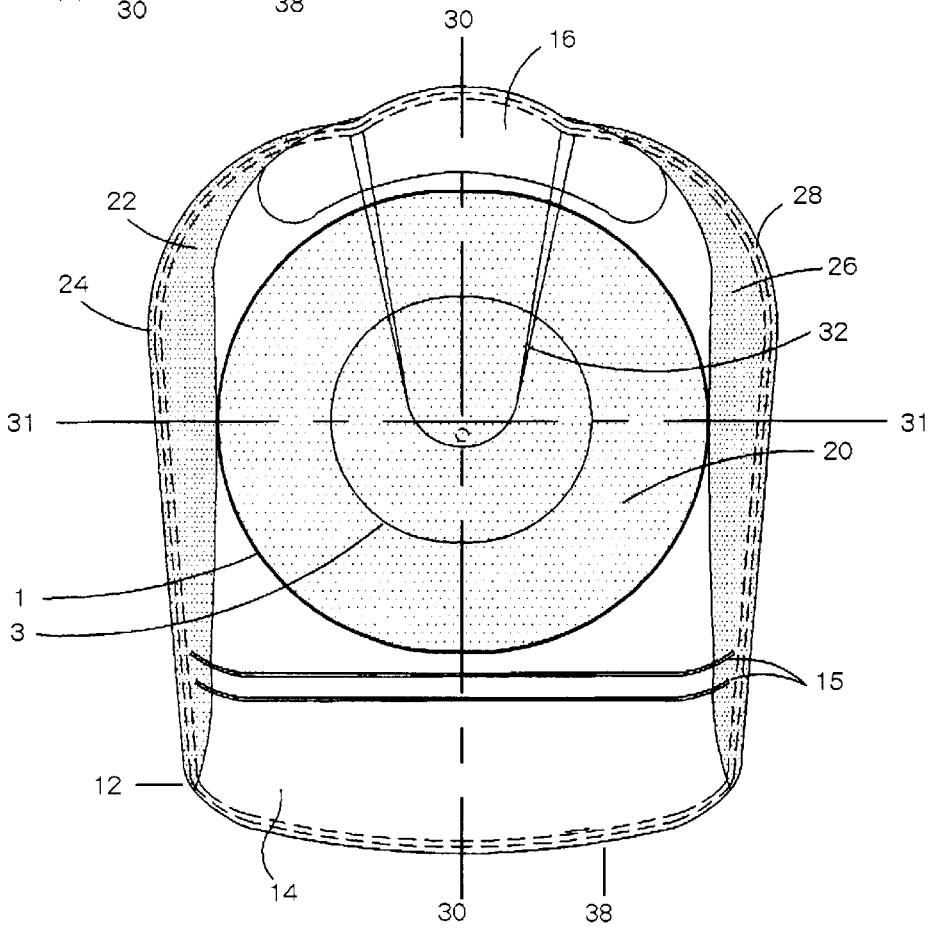
FIG. 2 is a top view of the novel foundation member depicted in FIG. 1, with a stippled circle being used to connote the central portion of the device upon which the lower pelvic portion of the user is to be principally positioned, with the upwardly curved side portions also being stippled.

With continuing reference to FIGS. 1 and 2, it is to be understood that the foundation member 12 comprises a front, lip-like portion 14, an upwardly inclined rear portion 16, and a central bowl portion 20. The upwardly curved side members 22 and 26 extend upwardly somewhat higher than the central portion 20, with these side portions being essentially equidistant from longitudinal centerline 30—30 extending through the central part of my device between the front portion 14 and the rear portion 16.

Each of the side members preferably has an enlarged, bead-like member extending along its uppermost edge, with bead-like member 24 extending along the top of side portion 22, and bead-like member 28 extending along the top of side portion 26. It will be noted that a bead-like member 38 extends across the forward most edge of the front, lip-like portion 14, with member 38 being visible in enlarged detail in FIGS. 5 and 5*a*.

In FIGS. 1 and 2, the side portions have been stippled to show that portions 22 and 26 will be under tension when the foundation member 12 has been placed in use by a seated user.

The stippled circle 1 indicates the top or outer edge of the central bowl portion, whereas stippled circle 3 indicates the area that is proportionally sized to the average pelvic outlet. Both circles 1 and 3 indicate the area known as the central bowl portion.

FIG. 2 indicates in clear detail, the entire central bowl portion, with central portion 3 to be understood to represent the base for the ischial tuberosities, that are to be located at its center. The central bowl portion 20 serves as the principal cupping area around the lower pelvic region and the muscles that join to the lower pelvis and coccyx. Because the soft tissues of the buttocks typically flow over the side and front of the foundation member, as generally indicated in FIG. 3*d*, it must be understood that the entire foundation member bears the weight of the seated user.

As will be explained hereinafter, the bead-like members 24 and 28, which extend along the top of side portions 22 and 26, respectively, form a type of tension member extending between the front, lip-like portion 14 and the rear portion 16 of the foundation member 12. Importantly, the side portions, along with their bead-like members 24 and 28, serve to pull the rear portion 16 forward at the time a user sits on the central portion 20, with the underside of the thighs of the user's legs resting on the front portion 14. Such forward motion of the rear portion serves to assist the side portions moving inwardly so as to bring about a highly desirable compression of the gluteal and piriformis muscles such that they cup around the ischial tuberosities so as to form a dome of cupped muscle tissue, whereas the gluteal muscles tend to remain in a desirably slack condition. This function will be explained in greater detail hereinafter.

Continuing with FIG. 1, there is a downwardly extending recess portion 32 at the rear part of the central portion, with this recess portion being disposed symmetrically along the longitudinal centerline 30—30. This downwardly extending recess portion commences approximately at a mid-portion of the centerline and extends rearwardly to the upwardly inclined rear portion 16. The downwardly extending recess portion 32 is disposed at approximately the location of the coccyx of a user seated on the central portion, with the downwardly extending recess portion serving to remove the possibility of considerable pressure being applied to the coccyx area of the seated user.

Figure 3A:
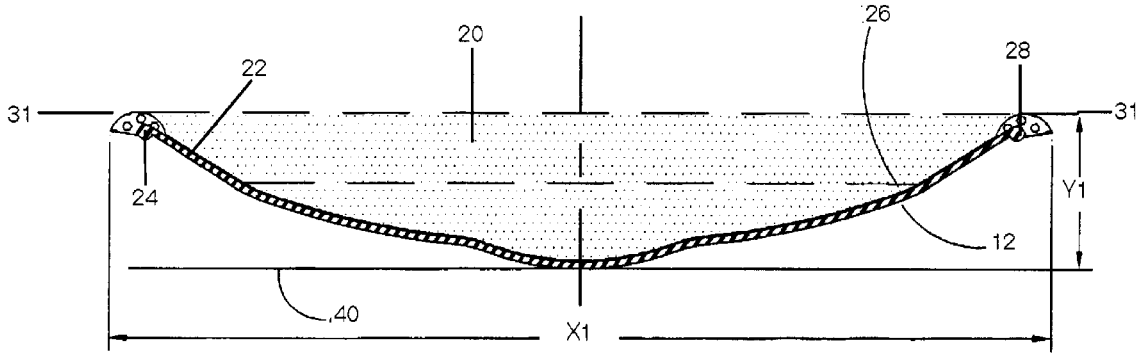
FIG. 3*a* is a cross sectional view across the width of my novel seating orthosis so as to reveal its normal configuration, with the stippling showing the central bowl portion, and with this view also showing the utilization of an overhanging transitional member in the form of foam padding or other soft textured material extending beyond the entire periphery of the foundation member.
Figure 3B:
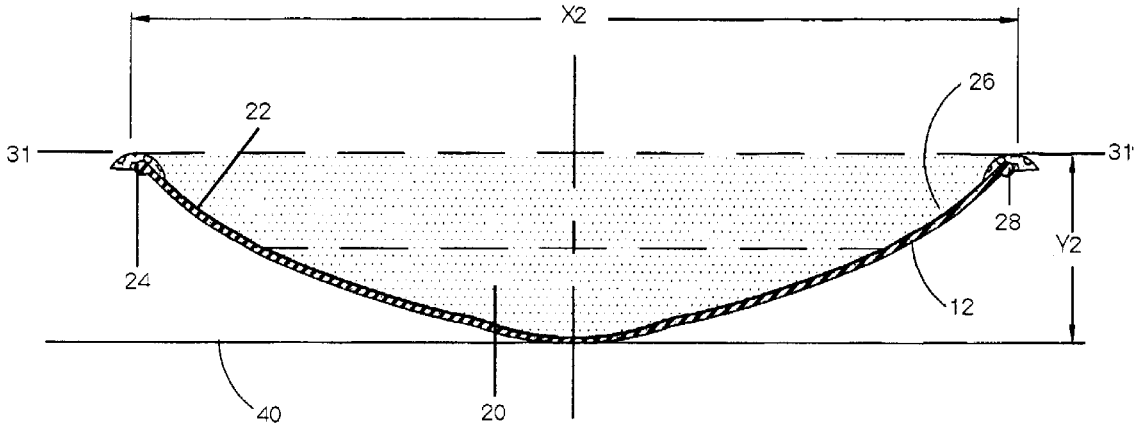
FIG. 3*b* is a view substantially identical to FIG. 3*a* but here showing my novel seating orthosis in its weight bearing mode, with the size of the central portion having increased under the user's weight, and the width of the device having been inwardly reduced toward the centerline.

In FIGS. 1 and 2 it will be noted I have shown a cutting plane 31—31 about which the cross sectional views appearing in FIGS. 3*a* and 3*b* were taken.

Figure 2A:
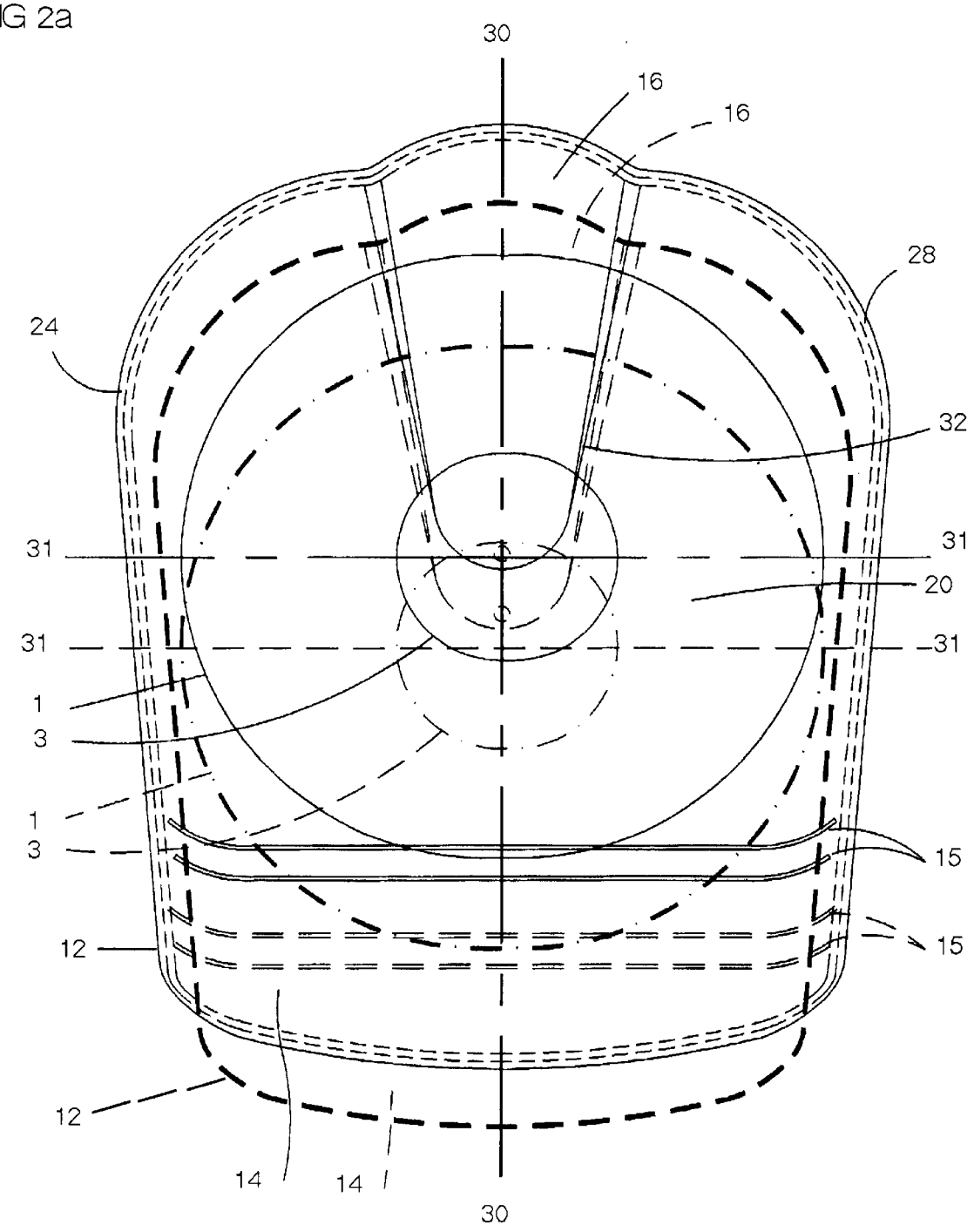
FIG. 2*a* is a view similar to FIG. 2 but to a larger scale and showing by the use of dashed lines, the shift that has taken place when my device has assumed its secondary configuration while bearing the weight of a seated user.

In FIG. 2*a* I have shown by the use of dashed lines, the shifting that takes place at the time weight has been placed upon the foundation member, and downward tilting of the front, lip-like portion 14 has occurred. The shifting of the larger circle 1 and the smaller circle 3 are specifically depicted by circles made up of dashed lines. In FIG. 2*a* it will be noted that the long dashed lines extending along the sides indicate that as a result of the placement of weight of the seated user upon the central portion of the device, the side edges 22 and 26 are caused to move inwardly and somewhat upwardly.

FIGS. 3*a* and 3*b* represent cross-sectional views of my novel seating orthosis in two different modes or circumstances, with these views being taken at the location of the above-mentioned cutting plane 31—31. FIG. 3*a* reveals the configuration of my device when it is not bearing the weight of a seated user. In this instance, a characteristic depth of my device is indicated by Y1, and the characteristic width is indicated by X1.

FIG. 3*b*, on the other hand, reveals the configuration of my seating orthosis when a user is seated thereon. FIG. 3*b* clearly depicts the fact that the central portion of my novel device assumes a more deeply curved configuration when bearing the weight of a user, and it is quite apparent that the new depth of the device, as indicated by Y2, exceeds the depth of Y1 of the device. It will be noted that I have utilized stippling in FIG. 3*b* to represent the volumetric increase of the central portion of the foundation member 12 when it is bearing the user's weight.

By way of example, the depth dimension Y1 of FIG. 3*a* may be 1.25 inches, whereas the depth dimension Y2 on FIG. 3*b* may be 2.25 inches. However, I am not to be limited to this.

As another example, the width dimension X1 in FIG. 3*a* may be 13 inches, whereas the width dimension X2 in FIG. 3*b* may be 11.5 inches. It is to be carefully noted that the side members have moved inwardly rather than outwardly during the application of the user's weight to the foundation member, this being due to the fact that the under surfaces of the user's thighs push downwardly on the forward portion 14, which brings about a tensioning of the side members and their bead-like upper surfaces. This tensioning of the side members causes this important inward movement of the side members.

FIGS. 3*a* and 3*b* also reveal that an overhanging transitional member 37 resides on the periphery of the foundation member 12. The overhanging transitional member 37 is of soft textured material, preferably made from closed cell cross linked polyethylene foam, although I am not to be limited to this. It is to be understood that the primary purpose of the overhanging transitional member 37 is to support the basic function of the foundation member 12 rather than being a mere pad providing a degree of softness to the upper surface of the foundation member. It will be noted in FIGS. 3*a* and 3*b* that the transitional portion 37 extends outwardly somewhat beyond the outer edge of the foundation member, thus resulting in a desirable degree of overhang. FIGS. 5 through 7, discussed hereinafter, reveal additional details of a typical overhang of the transitional member 37.

Figure 3C:
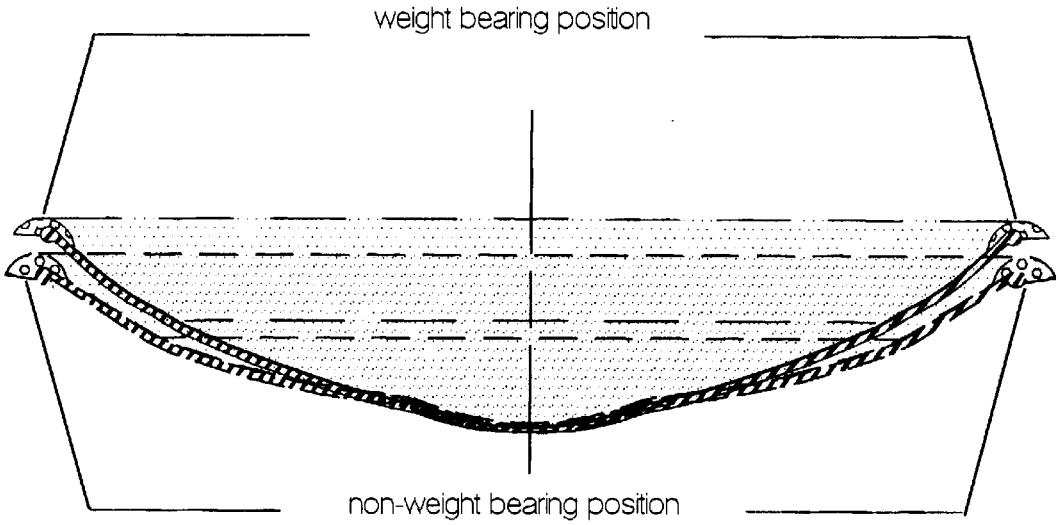
FIG. 3*c* is a view showing FIGS. 3*a* and 3*b* superimposed, with this view serving to illustrate how the side members are caused to move inward when the orthosis is in the weight bearing position, with this inward movement of the side members serving to bring about a novel cupping effect around the lower pelvic region of the seated user.
Figure 3D:
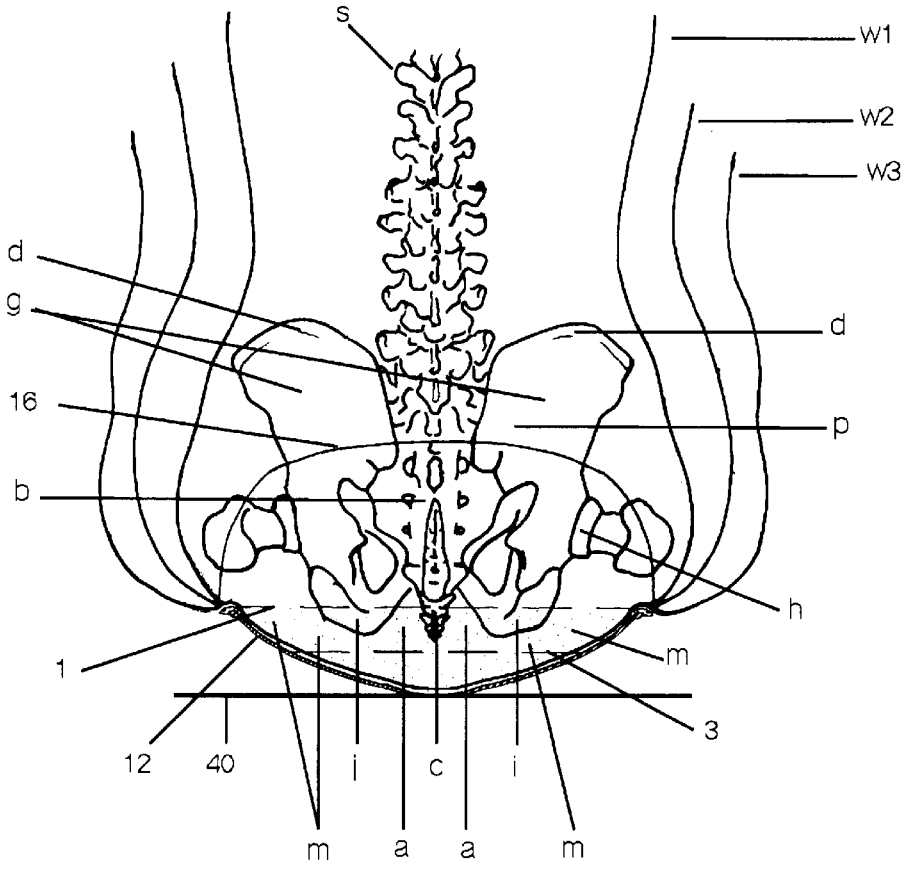
FIG. 3*d* involves an anatomical representation indicating my novel device in its secondary position in which the lower pelvis and ischial tuberosities are closely cupped by the side members, with this view showing that the device does not flex outward under body weight, even on a hard surface, and with this figure further showing the soft tissues of the buttocks residing on top of the peripheral bead member.

FIG. 3*c* represents a superimposition of FIGS. 3*a* and 3*b* and was created to emphasize the inward cupping effect of the upwardly curving side members and their bead-like members when these have when brought under tension by the weight of the seated user. The outline captioned WEIGHT BEARING POSITION clearly indicates that in a somewhat paradoxical manner, the side portions push inwardly and somewhat upwardly under the weight of the seated user. This is of course in contrast with the outline captioned NON-WEIGHT BEARING POSITION, in which the side members are actually lower than the position of the side portions under load. It is thus to be seen that in accordance with my highly advantageous design, the downward pressure of body weight does not serve to bend the side members downward.

FIG. 3*d*, taken at the cutting plane 31—31, reveals the addition of the anatomic details of a typical pelvic region in order to indicate a proportional relationship of the pelvic region to the size of my novel foundation member 12. This view, looking from the back of my novel device, involves the foundation member resting on a hard parent surface 40. Importantly, this view indicates the positioning of the ischial tuberosities i with respect to the central bowl portion 20. Also indicated are the positions of the side members 22 and 26, which are almost directly below the hip sockets h.

Figure 4A:
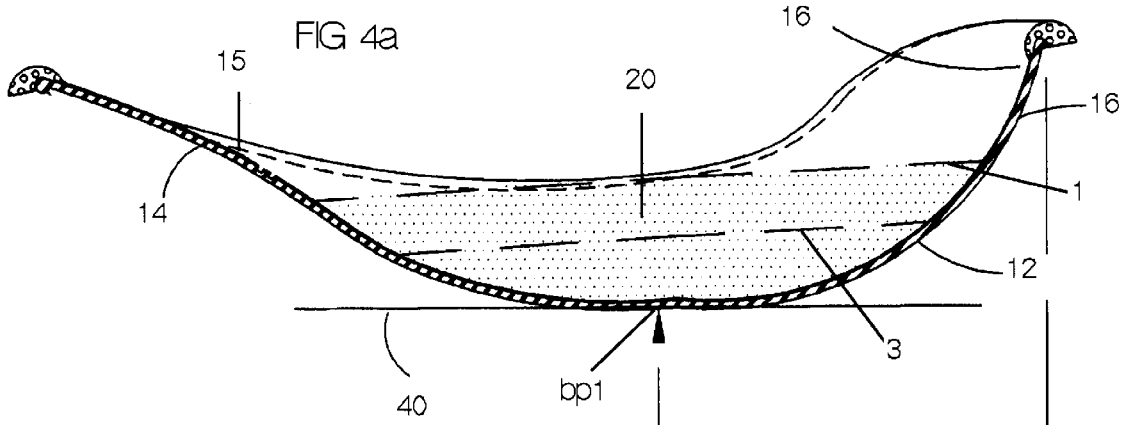
FIG. 4*a* is a longitudinal cross sectional view of my seating orthosis in its normal mode, with this view revealing the foundation member on a parent surface and bearing no weight, and with this view also illustrating the use of an overhanging, soft textured member attached around the periphery of my device.
Figure 4B:
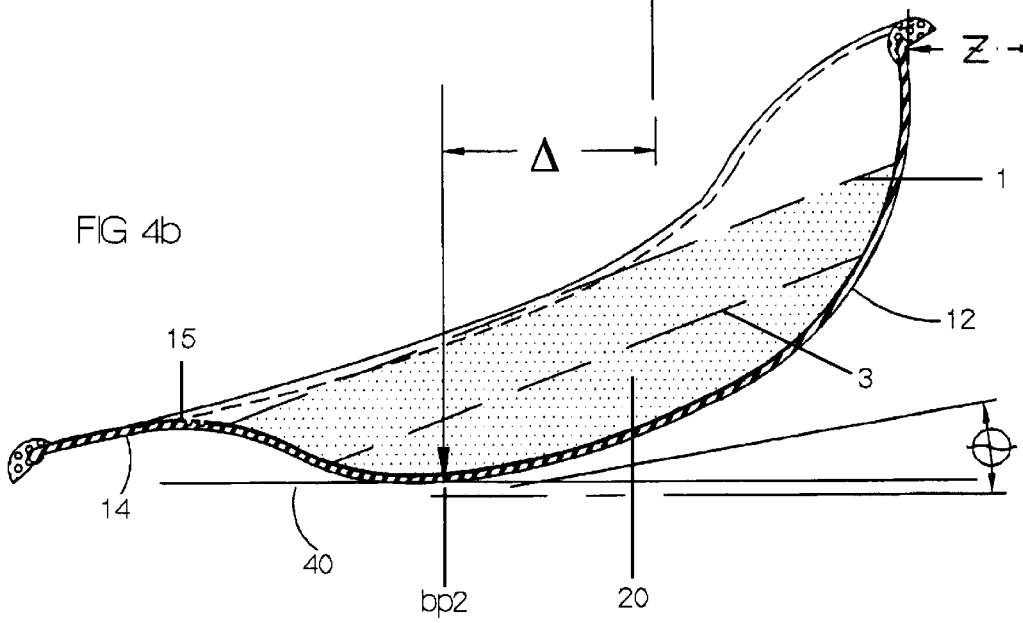
FIG. 4*b* is a view of the seating orthosis corresponding to FIG. 4*a*, but revealing the distinct secondary shape assumed as a result of a user's weight placed thereupon, and also revealing the device assuming a distinct angle to the horizontal when the front, lip-like portion of the device has undertaken substantial downward curvature under the weight of the user's upper leg portions.
Figure 4C:
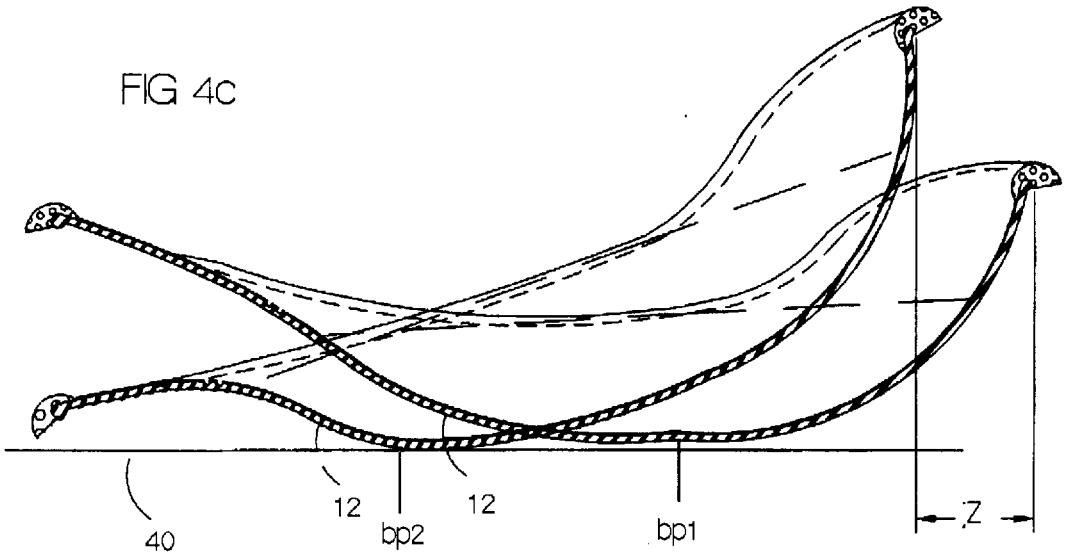
FIG. 4*c* is a view representing a superimposition of FIGS. 4*a* and 4*b*, with this view advantageously illustrating the forward movement of the rear portion of my device, and depicting the movement of the balance point from a first position to a more forward second position.
Figure 4D:
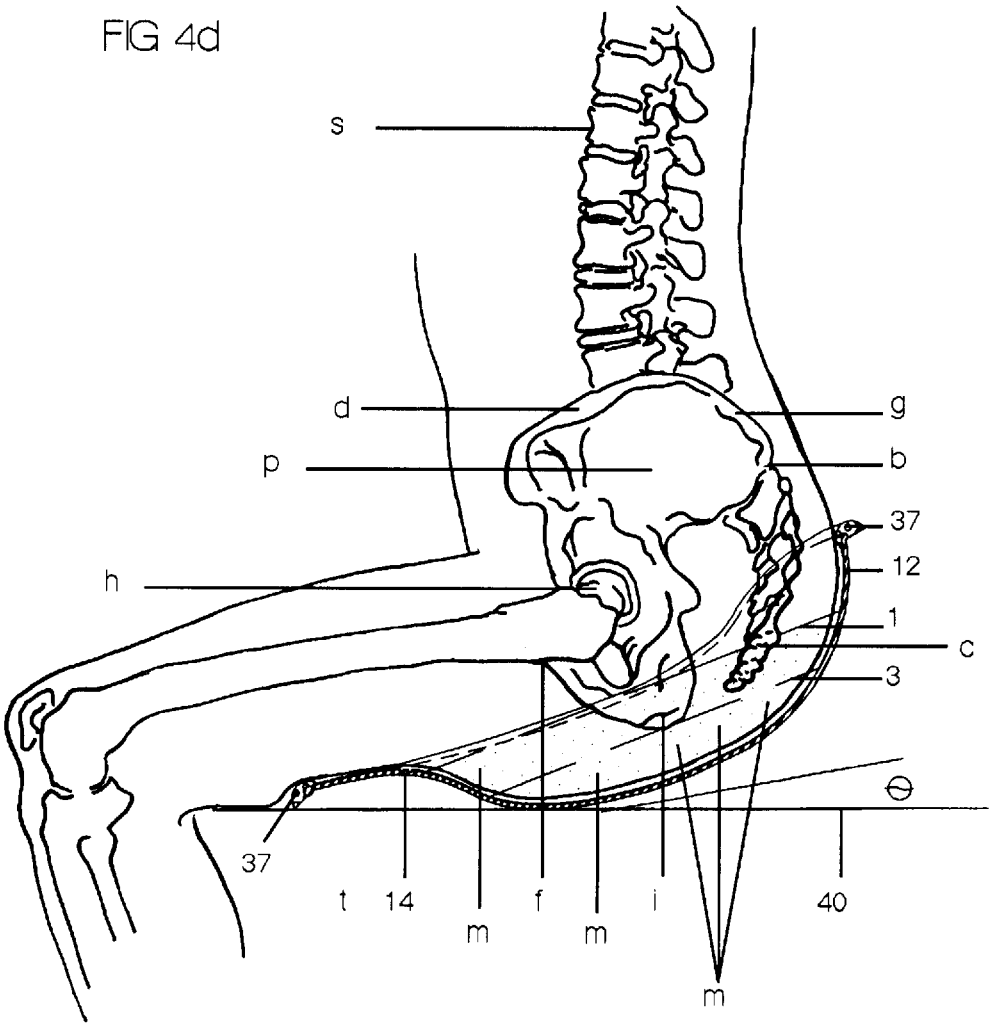
FIG. 4*d* bears a relationship to FIG. 4*b*, with this anatomical representation indicating the forward tilt undertaken by the pelvis when the foundation member has moved into its secondary shape and the balance point has shifted forward.

Other parts or components of the pelvic region depicted in FIG. 3*d* and FIG. 4*d* are as follows:

| | |
|---|---|
| a | pubic arch |
| b | sacrum |
| c | coccyx |
| d | crest of the ilium |
| f | symphysis pubis crest |
| g | posterior pelvic girdle |
| h | hip socket |
| i | ischial tuberosities |
| m | retained muscle tissue |
| p | pelvis |
| s | spine |
| t | thigh |
| w | soft tissues of various widths |

It is important to note that FIG. 3*d* shows the dramatic cupping effect upon the lower part of the pelvic region, with this cupping effect not extending to the soft tissues that overhang the periphery of the device. Soft tissues representing the outlines of buttocks of various sizes are denoted by W1, W2 and W3.

Turning now to FIGS. 4*a* and 4*b*, in FIG. 4*a* I show a cross sectional view of my novel seating orthosis taken at a location parallel to the centerline 30—30 of my device, with this view revealing the relationship of the front portion 14 to the rear portion 16 when the weight of a user is not being borne. This view also reveals that the central portion 20 resides on the parent surface 40 in approximately a horizontal attitude. The balance point BP1 during the no load condition is indicated in FIG. 4*a*.

The showing of FIG. 4*a* is to be contrasted with the representation of my device in FIG. 4*b*, for in latter figure the front portion 14 is shown as having been caused to undertake a considerable amount of downward curvature. This downward curvature is partly as a result of the weight of the lower pelvis of the user on the central portion 20 of the device 10, but more significant in this regard is the presence of the legs of the user, with the hamstring portions, that is, the underside of the upper thigh portions of the user's legs, resting on the front, lip-like portion 14 and causing a substantial amount of downward curvature, as depicted in FIG. 4*b*.

It is to be noted from FIG. 4*b* that the central portion 20 has assumed an angle θ to the parent surface 40, usually a horizontally disposed surface, as a result of the device bearing the weight of the user, with this angle typically being in the range of 5° to 25°. An angle of approximately 10° is typical.

By comparing FIG. 4*b* with FIG. 4*a* it will be seen that by the action of the bead-like members 24 and 28 and the downward curving of the front portion 14, the rear portion 16 has been caused to move forward a distance Z. The distance Z can range between 0.500 inches and 3.0 inches, with 2.0 inches being typical. FIG. 4*b* represents the distinctive secondary shape or secondary configuration undertaken by my novel seating orthosis when the central portion 20 and the front or forward portion 14 are bearing the user's weight. The shift between the location of balance point BP1 and the location of balance point BP2 as a result of this tilting is represented by the Δ.

FIG. 4*c*, representing a superimposition of FIGS. 4*a* and 4*b*, quite importantly shows the dramatic difference when the foundation member goes from its original non-weight bearing position into its secondary shape. This overlay distinctly exhibits the shift of central balance point from location BP1 forward to location BP2. Also depicted are the back member 16 shifting forward by distance Z, the central bowl portion being shifted forward and the front lip-like member bending down and coming in contact with the parent surface.

FIG. 4*d* bears a relationship to FIG. 4*b*, but this anatomical representation shows a typical pelvic region and spine, along with the thigh bone, with this figure clearly indicating the proportional size of the average pelvis to the foundation member 12. This anatomical illustration indicates the forward tilt that is undertaken by the pelvis when the foundation member 12 has moved into its secondary shape. Also illustrated is the effect of the weight of the upper body when the ischial tuberosities are residing in the center of the central bowl portion. This weight does not distort the secondary shape beyond a front lip-like member being bent downward, placing the side members and their bead-like edge members under tension and pulling the upwardly inclined rear portion 16 forward.

Also indicated in FIG. 4*d* is the increase in depth of the central bowl portion, helping to cup the gluteus muscles directly around the bottom outlet of the pelvis. A constant compression of the gluteal and piriformis muscles such that they cup around the ischial tuberosities is thus advantageously brought about.

It is obvious that my novel orthopedic device may be utilized in a variety of environments, such as on the seat of an automobile; on an item of furniture such as a couch or easy chair; upon a chair with a relatively hard bottom; or even on a hard seat, such as to be found in a stadium or the like. In any of these events, the central portion 20 will undertake a degree of angularity with respect to the horizontal (parent surface) in the general manner depicted in FIG. 4*b*.

Although the anatomical illustrations employed in FIGS. 3*d* and 4*d* have been utilized while the foundation member 12 is residing on a hard surface, it is to be understood that the secondary shape of the foundation member is also obtained while the member 12 is residing upon a resilient or soft surface. This secondary shape in soft surfaces floats down into the foams and fabric of ergonomic chairs and takes on the same secondary shape as if it was on a hard surface. I have chosen to show the illustrations on a hard surface because the overhanging soft tissues and the angle of the forward tilt of the foundation member is visually more dramatic. It is most important to keep in mind, however, that the same highly advantageous tilt and cupping action brought about by my novel device occurs essentially independently of the hardness or softness of the supporting surface.

The overhanging transitional member 37 of soft textured material is somewhat larger than the foundation member 12, thus accounting for the degree of overhang visible in FIGS. 3*a* and 3*b*, and in FIGS. 4*a* and 4*b*. This overhang is desirable in that it makes a relatively smooth transition from my device over to the "parent" seat member, which, as previously mentioned, may be an automobile seat, or any of a wide variety of other supporting surfaces.

With reference to FIG. 5, this view shows to a large and substantially realistic scale, the peripheral overhang 37. It is clear from this figure that the peripheral overhang 37 extends over the peripheral edge or bead 38 utilized along the front portion 14 of the foundation member 12. Overhang 37 preferably encircles the entire member. In the event my novel seating orthosis is used on a relatively soft parent surface, the overhang can blend with the parent surface along the sides of my device as well.

It has previously been mentioned that the overhanging transition member is selectively secured upon the upper surface of the foundation member 12, with this overlay 37 adding comfort, increasing the proper functioning of the foundation member and providing a slightly overhanging member making possible a non-abrupt transition to the parent member upon which my device rests. It is to be understood with regard to FIG. 5 that a user's buttocks are spanning over and beyond the foundation member to the parent surface, with the parent surface in this instance being a relatively soft seat member 42, such as an automobile seat. The peripheral edge 37 forms a smooth transition between the foundation member and the parent surface, thus contributing to the user's comfort.

When the foundation member is placed on a hard surface this overhanging transition member adds comfort at the time the bead-like edge member would be pushing up into the gluteus muscles. This permits the excess soft tissues and gluteus muscles not cupped around the ischial tuberosities and the coccyx to be more comfortably accommodated. Because the overhanging tissues do not come in contact with the parent surface immediately, the overhanging edge merely lessens the effect of its upwardly curving edge upon the soft tissues and muscle tissues of the buttocks.

FIG. 5*a* shows a detail of the peripheral edge of the member with its bead-like member covered with the overhanging transitional foam pad member. This detail further explains the need for the bead-like member to be covered as a transition for comfort, for this bead-like member would push up into the gluteal muscles. As the gluteal muscles pass over and beyond the peripheral bead-like member edge it lessens the effect that the overhanging soft tissues would feel. It is to be noted that FIG. 5*a* is in a non-weight bearing mode.

In accordance with my novel design, I find it preferable to construct the front, lip-like portion 14 of my device such that it will have a specific bend point at the front of the central bowl portion 20. One way I go about obtaining desired flexibility of the front portion of my device is to provide at least one but preferably a pair of generally parallel grooves 15 thereon. As was noted from FIG. 2, the grooves 15 extend across the front portion 14, with both of the grooves being substantially perpendicular to the longitudinal centerline 30—30. The grooves 15 not only serve to increase the flexibility of the front portion 14, but also serve to cause the foundation member 12 to bend so as to assume the desired secondary shape at the time the undersurface of the user's upper thighs come into contact with the front, lip-like portion 14 while the user is principally seated on the central portion 20. As previously mentioned, the downward bending of the front portion 14 acts through the bead-like members 24 and 28 so as to pull the rear portion 16 to move forward.

FIG. 6 is an overlay detail on one side of the centerline 30—30, with this view including a portion of the central bowl portion, the upwardly curved side portion, and the bead-like member 24 along with its overhanging transitional foam member. FIG. 6 is utilized to further emphasize the upward change in the upwardly curved side member, along with the deepening of the central bowl member in its secondary position. The side member, along with its bead-member being pulled toward the centerline creates a cupping action. This cupping action cups inward toward the centerline into muscle tissue, thus explaining the desirability of utilizing a foam member or other soft textured material around the periphery of the foundation member to lessen the transitional point of where muscle tissue flows over and beyond the foundation member.

FIG. 7 is a fragmentary view showing a detail of the front lip-like member 14, through section 30—30. The pair of grooves 15 are positioned on the foundation member directly at the point where the front lip-like member and the top of the central bowl-like member meet. As previously mentioned, these grooves are intended to cause bending at this specific location, rather than just to provide additional flexibility to this location. The grooves 15 assure that the secondary shape of the foundation member occurs identically each time the foundation member is placed under pressures from the seated user.

With reference to FIG. 8, this figure, as in FIG. 2, indicates the overhanging transitional soft textured member, typically of foam, that preferably extends around the entire periphery of the foundation member 12. Also indicated in FIG. 8 is the circular pattern 44 which indicates the area where the overhanging foam member 37 is glued, cemented or otherwise attached to the foundation member 12. This figure also illustrates the fact that the entire foundation member is placed under the buttocks and thighs of a user, and due to the measurements of the foundation member being proportioned with respect to the outlet and lower pelvis, the use of the transitional foam member is desirable because of the fact that muscle and soft tissues of the user's buttocks will overhang the periphery of the foundation member 12.

With regard to some preferred dimensions, when my novel device has been caused to move into its specific secondary shape, the central bowl portion is directly under the outlet of the pelvis. The bottom of the central bowl portion is the size of the average pelvic outlet, which is 3.25" to 5". The depth of the central bowl portion before changing into the secondary shape is the depth of the average pubic arch, being 1.25". This creates a central bowl portion having a top circumference of 9" with the middle circumference being 5". The total depth of the bowl in the secondary shape 2¼" deep.

When the device is in its specific secondary shape, the overall width from side to side, which includes the side edge periphery, are no wider than the average width of the crest of the ilium 13" and reduces width by cupping inwardly directly under the hip sockets is 11.5". The height of the periphery of the side portions range from top of the pubic arch is 1.25" to the bottom of the hip sockets is 3".

Where the front portion merges with the central bowl portion, when in its specific secondary shape extends upward to create the periphery of the central bowl portion, the height of the region is equal to the height of the symphysis pubis crest which is 3".

The upwardly sloping back portion that extends from the central bowl portion rises no higher than the base of the sacrum.

Given these dimensional relationships based on average bone dimensions of adult men and women, one can immediately see how the instant device is significantly different from any other seating structure. Its shape and structure bring about cupping in a highly advantageous manner around the lower pelvis so that the muscles attached to the pelvic bones are restricted from spreading. The gluteal and piriformis muscles are caused by my novel device to cup around the ischial tuberosities of the seated user and provide enough padding so that unlike conventional ergonomic devices, it is not merely the flexibility of my novel device that is of consequence in providing comfort.

It is also important to note that the upwardly curved central bowl portion along with its adjacent upwardly curved side portions, have a specific curve that allows to push up into the soft tissues and muscles directly around the lower pelvis and allow the excess soft tissues to flow over the top of the device and away from the device. In this manner the desired cupping effect is achieved around the bottom of the pelvis without having to support the musculature and soft tissues of the entire buttocks. Comfort is created in the instant device as a result of the structural relationships of a specific secondary shape that holds muscle tissue constant under and around the ischial tuberosities.

The foregoing preferred dimensions are provided as merely exemplary, and quite obviously I am not to be limited to such dimensions.

I claim:

1. An orthopedic device for improving posture while sitting, the orthopedic device having a foundation member configured for resting on a seating surface, the foundation member having a first portion configured to receive a user's lower pelvic region, and a second portion configured to receive a user'upper legs, the foundation member comprising means for applying an upwardly and inwardly compressive force when the lower pelvic region of the user is disposed in the first portion, and the foundation member further comprising an underside, at least a portion of which is arcuate and configured to rotate on the seating surface between a first position when the user's lower pelvic region is not disposed in the first portion, and a second position, rotationally forward of the first position, when the user's lower pelvic region is disposed in the first portion, to thereby cause a forward rotational tilting of the user's lower pelvic region after the lower pelvic region is placed in the first portion; and wherein the second portion has an arcuate rear portion with an upper edge and arcuate lateral portions each having an upper edge, and wherein the means for applying an upwardly and inwardly compressive force comprises tension members connecting the second portion to the first portion such that application of a downward force on the first portion causes an upward and inward movement of the upper edges of the arcuate rear portion and the arcuate lateral portions.

2. The orthopedic device for improving posture while sitting of claim 1, wherein the foundation member has lateral sides, and wherein the tension members comprise beads extending along the lateral sides of the foundation member.

3. An orthopedic device for improving support of a user's lower pelvic region, the device comprising:

a foundation member made of a flexible material, the foundation member including:

a first portion having an upwardly sloping rear side, upwardly sloping lateral sides, each terminating in an edge, and a forward side, the rear side, lateral sides and forward side forming a bowl shape and configured to receive the lower pelvic region of the user; and a second, lip-like portion extending forwardly from the forward side, and connection means connecting the first portion and the second portion and for causing upward and inward movement of the edges of the lateral sides, so as to apply an upward and inward compressive force on the lower pelvic region of the user when a downward pressure is placed on the second portion; and wherein the foundation member further comprises tension members in the form of a circumferential bead connect the first portion and the second portion such that application of downward pressure on the second portion causes an upward and inward movement of the lateral sides of the first portion.

4. An orthopedic device intended to be contacted by a lower pelvic region of a seated user, including the ischial tuberosities of the lower pelvis and their connected gluteal and piriformis muscles, said device comprising:

a foundation member, said foundation member being constructed from a single piece of memory retentive, flexible plastic and comprising a central bowl portion serving to receive the lower pelvic region of the seated user, said central bowl portion being integrally connected to a front, lip-like portion intended to be contacted by the under thighs of the seated user, said central bowl portion also being bounded by a pair of upwardly curved side portions and an upwardly inclined rear portion, said side portions being structurally closely related with said central bowl portion and curving upwardly somewhat higher than said central bowl portion, said side portions being so structurally related with said central bowl portion and connected by bead-like members that upon a user's weight being placed on said central bowl portion, and the user's lower thighs being placed on said front, lip-like portion, said side portions are placed under tension, causing them to move inwardly and upwardly, toward the longitudinal centerline of said device, thus to push and compress the gluteal and piriformis muscles such that they cup closely around the ischial tuberosities of the seated user; and further comprising a member of soft texture provided for the comfort of the seated user extending around the periphery of said foundation member, said member of soft texture overlying said bead-like members.

* * * * *